US009529307B2

(12) United States Patent
Veres et al.

(10) Patent No.: US 9,529,307 B2
(45) **Date of Patent: *Dec. 27, 2016**

(54) IMAGING SYSTEM FOR PATTERNING OF AN IMAGE DEFINITION MATERIAL BY ELECTRO-WETTING AND METHODS THEREFOR

(75) Inventors: Janos Veres, San Jose, CA (US); David K. Biegelsen, Portola Valley, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1093 days.

This patent is subject to a terminal disclaimer.

(21) Appl. No.: 13/548,155

(22) Filed: Jul. 12, 2012

(65) Prior Publication Data

US 2014/0013980 A1 Jan. 16, 2014

(51) Int. Cl.

| | |
|---|---|
| ***G03G 15/10*** | (2006.01) |
| ***G03G 15/22*** | (2006.01) |
| *G03G 13/28* | (2006.01) |

(52) U.S. Cl.

CPC ..... *G03G 15/10* (2013.01); *G03G 15/226* (2013.01); *G03G 13/28* (2013.01)

(58) Field of Classification Search

CPC ..... B41C 1/1058; G03G 13/283

See application file for complete search history.

(56) References Cited

U.S. PATENT DOCUMENTS 3,285,741 A 11/1966 Gesierich
3,741,118 A 6/1973 Carley
(Continued)

FOREIGN PATENT DOCUMENTS

DE 101 60 734 A1 7/2002
DE 103 60 108 A1 7/2004
(Continued)

OTHER PUBLICATIONS

Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).
(Continued)

*Primary Examiner* — Joshua D Zimmerman
(74) *Attorney, Agent, or Firm* — Ronald E. Prass, Jr.; Prass LLP

(57) ABSTRACT

A system comprises an electro-wetting subsystem, a transfer subsystem, an imaging member, and an inking subsystem. The electro-wetting subsystem comprises a photo-responsive photoreceptor, a charging mechanism, an image definition material reservoir, a charge erase mechanism, and an exposure subsystem, such as a light source and rotating polygon forming a raster output scanner (ROS) disposed for exposure of the photoreceptor through the image definition material reservoir. The imaging member comprises a reimageable surface having certain properties, such as having a low surface energy to promote ink release onto a substrate. In operation, the photoreceptor is charged areawise. An exposure pattern is formed by the exposure subsystem on the surface of the charged photoreceptor, which is developed with image definition material. The image definition material pattern is transferred to the reimageable surface. The pattern is developed with ink. The inked image may be transferred to a substrate.

26 Claims, 7 Drawing Sheets

(56) References Cited

U.S. PATENT DOCUMENTS

| | | | | |
|---|---|---|---|---|
| 3,800,699 | A | 4/1974 | Carley | |
| 3,877,372 | A | 4/1975 | Leeds | |
| 4,627,349 | A | 12/1986 | Claussen | |
| 4,887,528 | A | 12/1989 | Ruge | |
| 5,067,404 | A | 11/1991 | Frunder et al. | |
| 5,701,815 | A | 12/1997 | Bocko | |
| 5,855,173 | A | 1/1999 | Chatterjee et al. | |
| 6,125,756 | A | 10/2000 | Nussel et al. | |
| 6,146,798 | A | 11/2000 | Bringans et al. | |
| 6,318,264 | B1 | 11/2001 | D'Heureuse et al. | |
| 6,561,090 | B1 | 5/2003 | Spooner | |
| 6,725,777 | B2 | 4/2004 | Katano | |
| 6,841,366 | B1 | 1/2005 | Bower et al. | |
| 6,901,853 | B2 | 6/2005 | Baldy et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,191,705 | B2 | 3/2007 | Berg et al. | |
| 8,586,277 | B1 * | 11/2013 | Veres | G03G 15/10 399/239 |
| 2003/0167950 | A1 | 9/2003 | Mori | |
| 2004/0011234 | A1 | 1/2004 | Figov | |
| 2005/0178281 | A1 | 8/2005 | Berg et al. | |
| 2005/0258136 | A1 | 11/2005 | Kawanishi | |
| 2006/0152566 | A1 | 7/2006 | Taniuchi | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi | |
| 2008/0223240 | A1 | 9/2008 | Drury | |
| 2010/0031838 | A1 | 2/2010 | Lewis et al. | |

FOREIGN PATENT DOCUMENTS

| | | | |
|---|---|---|---|
| DE | 10 2006 050744 | A1 | 4/2008 |
| DE | 10 2008 062741 | | 7/2010 |
| EP | 1 935 640 | A2 | 6/2008 |
| EP | 1 938 987 | A2 | 7/2008 |
| EP | 1 964 678 | A2 | 9/2008 |
| WO | 2006/133024 | | 12/2006 |
| WO | WO 2009025821 | A1 | 2/2009 |

OTHER PUBLICATIONS

Katano et al., "The New Printing System Using the Materials of Reversible Change of Wettability", International Congress of Imaging Science 2002, Tokyo, pp. 297 et seq. (2002).
U.S. Appl. No. 13/095,714, Apr. 27, 2011, Stowe et al.
U.S. Appl. No. 13/095,737, Apr. 27, 2011, Stowe et al.
U.S. Appl. No. 13/095,745, Apr. 27, 2011, Stowe et al.
U.S. Appl. No. 13/095,757, Apr. 27, 2011, Stowe et al.
U.S. Appl. No. 13/095,764, Apr. 27, 2011, Stowe et al.
U.S. Appl. No. 13/095,773, Apr. 27, 2011, Stowe et al.
U.S. Appl. No. 13/095,778, Apr. 27, 2011, Stowe et al.
U.S. Appl. No. 13/204,515, Aug. 5, 2011, Stowe et al.
U.S. Appl. No. 13/204,526, Aug. 5, 2011, Stowe et al.
U.S. Appl. No. 13/204,548, Aug. 5, 2011, Stowe et al.
U.S. Appl. No. 13/204,560, Aug. 5, 2011, Pattekar et al.
U.S. Appl. No. 13/204,567, Aug. 5, 2011, Stowe et al.
U.S. Appl. No. 13/204,578, Aug. 5, 2011, Stowe et al.
U.S. Appl. No. 13/366,947, Feb. 6, 2012, Biegelsen.
U.S. Appl. No. 13/426,209, Mar. 21, 2012, Liu et al.
U.S. Appl. No. 13/426,262, Mar. 21, 2012, Liu et al.
U.S. Appl. No. 13/548,127, Jul. 12, 2012, Veres et al.
U.S. Appl. No. 13/548,134, Jul. 12, 2012, Veres et al.
U.S. Appl. No. 13/548,146, Jul. 12, 2012, Veres et al.
U.S. Appl. No. 13/548,151, Jul. 12, 2012, Veres et al.
U.S. Appl. No. 13/548,157, Jul. 12, 2012, Veres et al.

* cited by examiner

IMAGING SYSTEM FOR PATTERNING OF AN IMAGE DEFINITION MATERIAL BY ELECTRO-WETTING AND METHODS THEREFOR

BACKGROUND

The present disclosure is related to marking and printing methods and systems, and more specifically to methods and systems for variably marking or printing data using lithographic and electrophotographic systems and methods.

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a fountain solution (typically consisting of water and a small amount of alcohol as well as other additives and/or surfactants to reduce surface tension). The hydrophobic regions repel fountain solution and accept ink, whereas the fountain solution formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Also, the surface roughness of the offset blanket cylinder helps to deliver a more uniform layer of printing material to the substrate free of defects such as mottle. Sufficient pressure is used to transfer the image from the offset cylinder to the substrate. Pinching the substrate between the offset cylinder and an impression cylinder provides this pressure.

In one variation, referred to as dry or waterless lithography or driography, the plate cylinder is coated with a silicone rubber that is oleophobic and physically patterned to form the negative of the printed image. A printing material is applied directly to the plate cylinder, without first applying any fountain solution as in the case of the conventional or "wet" lithography process described earlier. The printing material includes ink that may or may not have some volatile solvent additives. The ink is preferentially deposited on the imaging regions to form a latent image. If solvent additives are used in the ink formulation, they preferentially diffuse towards the surface of the silicone rubber, thus forming a release layer that rejects the printing material. The low surface energy of the silicone rubber adds to the rejection of the printing material. The latent image may again be transferred to a substrate, or to an offset cylinder and thereafter to a substrate, as described above.

The above-described lithographic and offset printing techniques utilize plates which are permanently patterned, and are therefore useful only when printing a large number of copies of the same image (long print runs), such as magazines, newspapers, and the like. Furthermore, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Lithography and the so-called waterless process provide very high quality printing, in part due to the quality and color gamut of the inks used. Furthermore, these inks—which typically have a very high color pigment content (typically in the range of 20-70% by weight)—are very low cost compared to toners and many other types of marking materials. Thus, while there is a desire to use the lithographic and offset inks for printing in order to take advantage of the high quality and low cost, there is also a desire to print variable data from page to page. Heretofore, there have been a number of hurdles to providing variable data printing using these inks. Furthermore, there is a desire to reduce the cost per copy for shorter print runs of the same image.

One problem encountered is that offset inks have too high a viscosity (often well above 50,000 cps) to be useful in nozzle-based inkjet systems. In addition, because of their tacky nature, offset inks have very high surface adhesion forces relative to electrostatic forces and are therefore difficult to manipulate onto or off of a surface using electrostatics. (This is in contrast to dry or liquid toner particles used in electrographic systems, which have low surface adhesion forces due to their particle shape and the use of tailored surface chemistry and special surface additives.)

Efforts have been made to create lithographic and offset printing systems for variable data in the past. One example is disclosed in U.S. Pat. No. 3,800,699, incorporated herein by reference, in which an intense energy source such as a laser to pattern-wise evaporate a fountain solution.

In another example disclosed in U.S. Pat. No. 7,191,705, incorporated herein by reference, a hydrophilic coating is applied to an imaging belt. A laser selectively heats and evaporates or decomposes regions of the hydrophilic coating. Next a water based fountain solution is applied to these hydrophilic regions rendering them oleophobic. Ink is then applied and selectively transfers onto the plate only in the areas not covered by fountain solution, creating an inked pattern that can be transferred to a substrate. Once transferred, the belt is cleaned, a new hydrophilic coating and fountain solution are deposited, and the patterning, inking, and printing steps are repeated, for example for printing the next batch of images.

In yet another example, a rewritable surface is utilized that can switch from hydrophilic to hydrophobic states with the application of thermal, electrical, or optical energy. Examples of these surfaces include so called switchable polymers and metal oxides such as $ZnO_2$ and $TiO_2$. After changing the surface state, fountain solution selectively wets the hydrophilic areas of the programmable surface and therefore rejects the application of ink to these areas.

High-speed inkjet printing is another approach currently utilized for variable content printing. Special low-viscosity inks are used in these processes to permit rapid volume printing that can produce variable content up to page-by-page content variation. High-speed electrophotographic processes are also known.

However, there remain a number of problems associated with these techniques. For example, the process of selective evaporation of fountain solution requires a relatively high-powered, coherent radiation source, which generates heat and consume undesirably large amount of power. Such high-powered radiation sources are also quite expensive.

High-speed inkjet systems and process rely on special low viscosity inks that produce a non-standard final printed product. Such inks are also limited in the color ranges available. Further, such inks are relatively quite costly.

High-speed electrophotographic systems and process require "liquid toners" (electrophotography typically being a dry process). These liquid toners are essentially charged toner particles suspended in an insulating liquid. Producing an appropriate liquid toner that appropriately balances color, ability to charge, cleanability, and low cost has proven difficult.

Switchable coatings, especially the switchable polymers discussed above, are typically prone to wear and abrasion and expensive to coat onto a surface. Another issue is that they typically do not transform between hydrophobic and hydrophilic states in the fast (e.g., sub-millisecond) switching timescales required to enable high-speed variable data printing. Therefore, their use would be mainly limited to short-run print batches rather than to truly variable data high speed digital lithography wherein every impression can have a different image pattern, changing from one print to the next.

SUMMARY

Accordingly, the present disclosure addresses the above problems, as well as others, enabling the printing of variable content without complex toners and supporting systems. The present disclosure is directed to systems and methods for providing hybrid electrophotography and lithography.

A system according to one implementation of the present disclosure comprises an electrowetting subsystem, a transfer subsystem, an imaging member, and an inking subsystem. The electrowetting subsystem comprises a drum, plate or the like (e.g., a photoreceptor) having one or more layers that facilitate attracting materials such as electrolytes, ink, etc. to a surface thereof. The one or more layers are positioned adjacent an electrolyte bath held, for example, at an electrical potential suitable to drive an electrowetting process. The one or more layers may correspondingly be held at ground potential.

The one or more layers are exposed (e.g., by a scanned laser beam) through the electrolyte bath. The exposure creates a latent electrostatic image on the surface of the one or more layers, and the electrolytes in the electrolyte bath adhere to the charged portions of the one or more layers.

The electrolytes may be ink-phobic. Alternatively, the electrolytes may carry with them (e.g., the charged particles or electrolytes molecules are designed to entrain) a fluid that functions as an ink-phobic image definition material, rejecting ink in subsequent steps. For this reason, in certain embodiments the image definition material is also referred to herein as liquid toner. It will be appreciated that while we refer to a material as toner in the present disclosure, this reference is for convenience and clarity, and non-toner or toner-like materials that provide the same or similar functionality are within the scope of the present disclosure. If present, the toner particles preferably have no pigmentation visible to the human eye.

In certain implementations, the toner is an insulating fluid carrying image definition electrolytes. In certain embodiments, the electrolytes are either bifunctional (ink-phobic at one end, ink-philic on the other) or monofunctional (ink-philic). The electrolytes are charged in solution.

Exposure of the photoreceptor surface allows the photoconductor to transport charge at the exposed regions, so that a charge pattern is present on the photoreceptor surface. The charge on the photoreceptor surface and opposite charge on the electrolytes attract. As the photoreceptor surface exits the bath, electrolytes (and fluid) cover the surface in regions corresponding to where the surface was exposed. A negative pattern of the image to be printed is therefore formed of the image definition material on the photoreceptor surface. This negative image is then transferred to a reimageable surface.

The negative image is then developed with an ink having desirable properties such as having an appropriate color, providing a desirable final surface quality, having a low cost, being environmentally benign, and so on. Ink is not transferred to the reimageable surface in the regions where the image definition material resides. In those regions the image definition material splits and the ink stays with the inking roller. The inked image is then transferred to a substrate at a nip roller or the like. Post printing, much of the image definition material will be evaporated from the reimageable surface or transferred to the substrate where it will quickly evaporate, leaving the inked image. An optional cleaning subsystem will remove any residual image definition material and ink, readying the imaging member for a next printing pass.

The above is a summary of a number of the unique aspects, features, advantages, and implementations of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details are merely summarized or are omitted so as not to unnecessarily obscure the details of the present disclosure. Thus, where details are otherwise well known, we leave it to the application of the present disclosure to suggest or dictate choices relating to those details.

Figure 1:
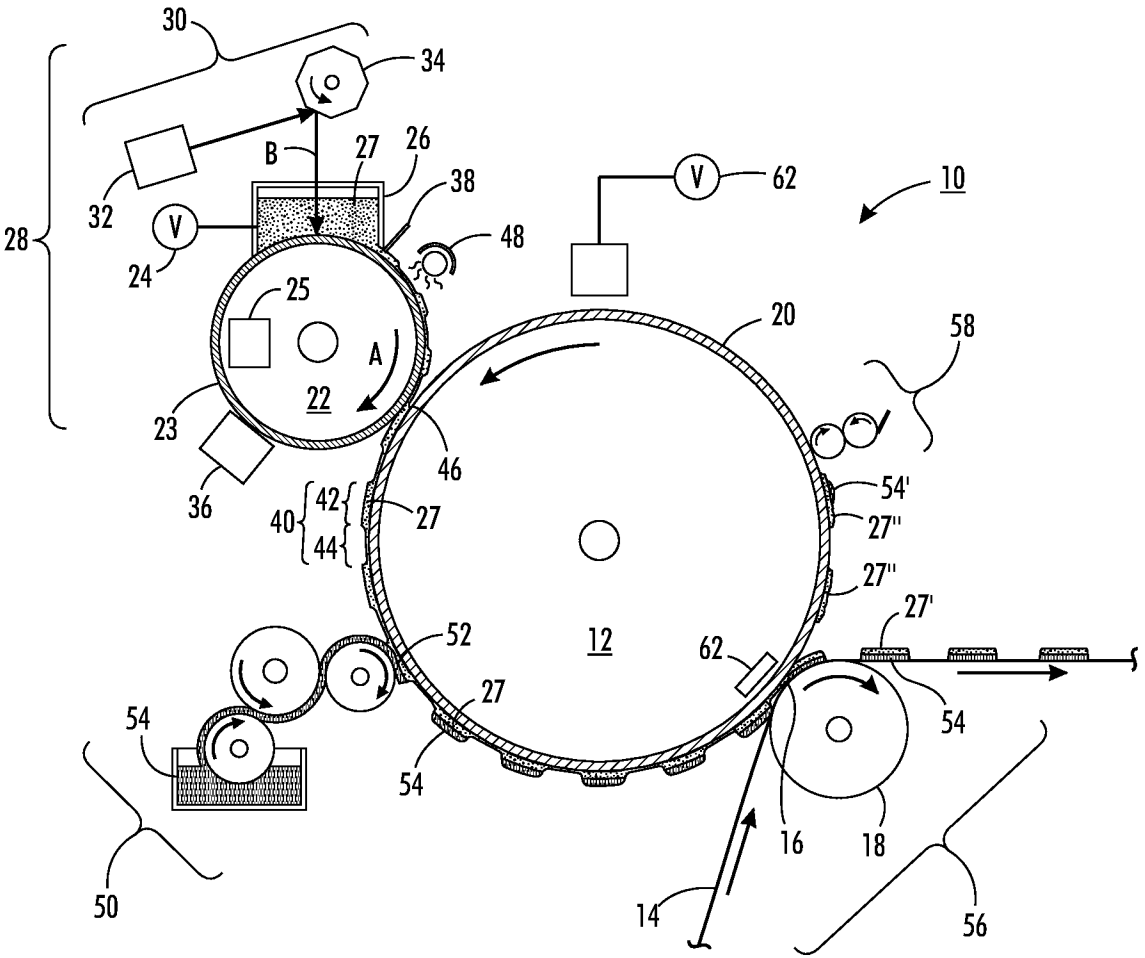
FIG. 1 is a side view of a system for variable lithography according to an implementation of the present disclosure.

With reference to FIG. 1, there is shown therein a system 10 for electrophotographic patterning of a image definition material according to one implementation of the present disclosure. System 10 comprises an imaging member 12, in this implementation a drum, but may equivalently be a plate, belt, etc., surrounded by a number of subsystems described in detail below. Imaging member 12 applies an ink image to substrate 14 at nip 16 where substrate 14 is pinched between imaging member 12 and an impression roller 18. A wide variety of types of substrates, such as paper, plastic or composite sheet film, ceramic, glass, etc. may be employed.

A wide latitude of marking materials may be used including those with pigment densities greater than 10% by weight including but not limited to metallic inks or white inks useful for packaging. For clarity and brevity of this portion of the disclosure we generally use the term ink, which will be understood to include the range of marking materials such as inks, pigments, and other materials, which may be applied by systems and methods, disclosed herein.

In one implementation, imaging member 12 comprises a reimageable surface layer 20 formed over a structural mounting layer (for example metal, ceramic, plastic, etc.), which together forms a rewriteable printing blanket. Additional structural layers, such as an intermediate layer (not shown) below reimageable surface layer 20 may be electrically insulating (or conducting), thermally insulating (or conducting), have variable compressibility and durometer, and so forth. Typically, blankets are optimized in terms of compressibility and durometer using a 3-4 ply layer system that is between 1-3 mm thick with reimageable surface layer 20 designed to have optimized texture, toughness, and surface energy properties.

Reimageable surface layer 20 should have a weak adhesion force to the ink (i.e., be relatively ink-phobic), yet sufficiently good wetting properties with the ink to promote uniform (free of pinholes, beads or other defects) inking of the reimageable surface and to promote the subsequent forward transfer lift-off of the ink onto the substrate. (Here the presence of oil incorporated into the plate may also aid subsequent transfer.) Silicone is one material having this property. Other materials providing this property may alternatively be employed, such as certain blends of polyurethanes, fluorocarbons, etc.

An electrolytic image definition material subsystem 28 is disposed proximate imaging member 12. Electrolytic image definition material subsystem 28 comprises a photo-responsive photoreceptor 22, a charging mechanism 24, an image definition material reservoir 26, and a charge erase mechanism 36. The photoreceptor 22 may have a low surface energy surface, which can be provided by surface coating, surface functionalization or surface topography or their combination. For example, a relatively thin dielectric layer 23 such as an amorphous fluoropolymer (e.g. DuPont Teflon AF) may be disposed over the surface of photoreceptor 22, in one example, on the order of 1 micron thick or thinner (although thicker layers are also contemplated). Optionally the dielectric may also serve as a layer across which photo-induced charge accumulates.

Electrolytic image definition material subsystem 28 further comprises an exposure subsystem 30, such as a light source (e.g., laser) 32 and rotating polygon 34 forming a raster output scanner (ROS), LED array (not shown), and so on. In the case of a laser, source 32 is both pulsed, such as by a controller (not shown) and scanned, such as by polygon 34. In the case of an LED array or light bar, the individual elements comprising the array are modulated to produce the desired exposure pattern line-by-line. By way of exposure, the scanned and pulsed beam or pulsed linear array creates a latent charge image on the surface of photoreceptor 22.

It is understood that for the purposes of this disclosure, the term "light" is used to refer to wavelengths of electromagnetic radiation for exposure of photoreceptor 22. As used herein, "light" may be any of a wide range of wavelengths from the electromagnetic spectrum, whether normally visible to the unaided human eye (visible light), ultraviolet (UV) wavelengths, infrared (IR) wavelengths, micro-wave wavelengths, and so on.

Image definition material reservoir 26 is configured to contain image definition material 27, such as an electrolyte or an insulating fluid containing at least one charged ionic species. The image definition material itself may be insulative, such as ion-free water or isoparaffinic fluid (e.g., Isopar™, ExxonMobil Chemical Corp.), with ionized species dissolved therein.

In certain embodiments, image definition material 27 may comprise image definition particles or molecules—herein collectively referred to as particles. The image definition particles may be either bi-functional or mono-functional. Bi-functional particles are particles configured to have opposite poles, and at one pole the particles are attractive to an ink to be applied to substrate 14 (i.e., are ink-philic at this pole), and at the other pole the particles reject the ink to be applied to substrate 14 (i.e., are ink-phobic at this pole). Therefore, bi-functional particles are capable of wetting the ink at one pole, and wetting the ink-phobic reimageable surface 20 at the other or vice versa. Mono-functional particles are entirely either ink-phobic or ink-philic.

For reasons explained further below, the particles may also have a surface quality and composition such that they provide a degree of liquid drag within the image definition material. In one implementation, the particles may comprise at least in part a polymer aggregate including charge control agents. The polymer material may be partially cross-linked to provide a plurality of aggregates.

Image definition material reservoir 26 is further configured to retain fluid 27 therein in physical contact with the surface of photoreceptor 22. In operation, photoreceptor 22 rotates, for example in the direction of arrow A in FIG. 1. As it rotates, an amount of fluid 27 in reservoir 26 is pulled along on its surface, and regulated, for example by a doctor blade 38 (not shown), or the like. In a variation of this embodiment, in place of a reservoir, image definition material may be metered onto photoreceptor 22, for example by a metering roller or the like. In this variation, exposure of the photoreceptor is from the back side, or prior to the application of the image definition material, as described further below.

In one embodiment, image definition material reservoir 26 is further configured to receive the output of exposure subsystem 30, in the form of a light beam B that essentially can travel through the image definition material 27 retained therein and be incident on reimageable surface 20.

Figure 2:
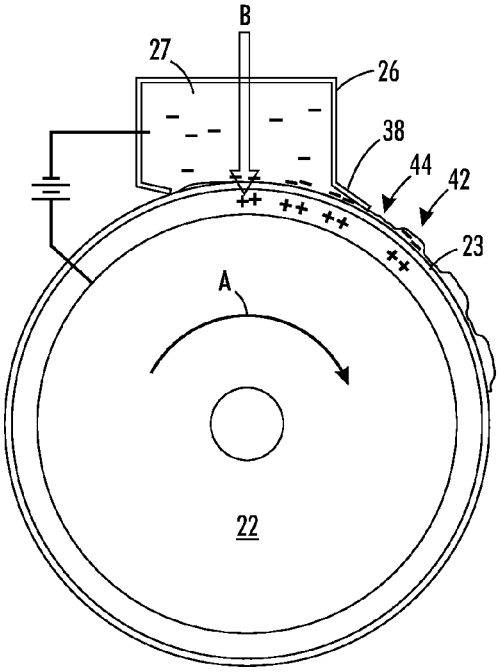
FIG. 2 is side-view, cut-away illustration of a mechanism for selectively applying image definition material to a surface of a photoreceptor according to one implementation of the present disclosure.

With reference to both FIGS. 1 and 2, a first voltage is applied to electrolytic image definition material 27 (or ionic species therein), for example, by charging mechanism 24, and a second voltage is applied to photoreceptor 22 (such as at the back side thereof), for example, by charging mechanism 25. A relatively high voltage difference is thereby created between image definition material 27 and photoreceptor 22; that is, a voltage V is applied across the photoreceptor 22 and dielectric layer 23 stack. (We note that a dielectric layer 23 substantially thinner than the photoreceptor layer 22 is desirable. However its presence is not necessary. If the ionized species in the electrolytic image definition material 27 does not readily recombine with opposite charge at surface of photoreceptor 22 then a dielectric layer is not needed. Ionized species for example could consist of particles or molecules with charge confined to the interior. The outer part of such particles or molecules can then act as a dielectric layer to keep opposite charges apart sufficiently to prevent substantial recombination.) Imagewise illumination of the photoreceptor 22 enables, at the point of illumination, conduction through the photoconductive layer up to the back side of thin dielectric layer 23. For sufficient illumination, the dielectric layer capacitance can be fully charged to a value $Q=C_dV$, where Q is the total charge in a given area, $C_d$ is the capacitance of the dielectric 23, and V is the voltage now locally dropped across the dielectric 23 between its back side and electrolyte side. A high field is thereby developed across dielectric layer 23 with a high electron surface charge density under the dielectric layer in the unexposed regions. In the unexposed regions the charge density is much smaller. The ratio of the charge density in the exposed region, $Q_{light}$, to the charge density in an unexposed region, $Q_{dark}$, is equal to the ratio of the capacitance of the dielectric layer 23 to that of the dielectric layer and photoconductor layer in series. As a simple example, if the photoreceptor layer 22 is 9 times thicker than the dielectric layer 23 and if the dielectric constants of the two layers are the same, then the capacitance of the dielectric layer alone is 10 times as large as the stack. Thus if the voltage is allowed to be dropped across the dielectric layer 23 then the charge density in the illuminated regions is 10 times larger than the charge density in the unilluminated regions. Similarly, if the dielectric layer 23 has a relatively high dielectric constant, the charge density will be relatively high and the electro-wetting energy lowering will be relatively high. The field due to the charges attracts ionized electrolyte species of charge (here positive) opposite to that on the photoreceptor side of dielectric layer 23, thus lowering the interfacial energy and converting the fluid interface from non-wetting to wetting. Thus, charge at the interface of photoreceptor 22 and dielectric layer 23 attracts oppositely charged electrolytic fluid (or ionic species) as photoreceptor 22 travels through fluid in reservoir 26.

In non-illuminated regions the positive charge is far smaller and the fields coupling to the electrolytic ions are relatively weak. Energetically, the negative ion attraction to the fluid-dielectric interface is too weak in this region to substantially lower the interfacial energy of the fluid on the dielectric and convert that region from non-wetting to wetting. (The contact angle stays greater than 90 degrees, and the fluid stays in the bath instead of pulling free and transporting with the imaging member.)

Thus, the ionized species in the electrolyte fluid are attracted to the charge image on the photoreceptor. The ion binding leads to energy lowering at the liquid-imaging member interface, which binds image definition material 27 to the surface of dielectric layer 23 (electro-wetting). The electro-wetted regions carry some amount of fluid with them depending on the splitting conditions as photoreceptor 22 exits reservoir 26. Image definition material 27 may then act as a positive or negative patterning solution.

As the surface of photoreceptor 22, with charged and uncharged regions, leaves the electrolyte bath (for example, through doctor blade 38), the electrolytic image definition material is preferentially attracted to the charged regions. A layer 40 of fluid from reservoir 26 is formed over the surface of photoreceptor 22. Layer 40 has regions 42 of relatively high attraction to photoreceptor 22 and hence are relatively thick, and regions 44 of relatively low attraction to photoreceptor 22 and hence are relatively thinner. Regions 42 correspond to locations over photoreceptor 22 that are exposed by exposure subsystem 30 (i.e., regions of charge separation in the photoreceptor layer), and regions 44 correspond to locations over photoreceptor 22 that are not exposed by exposure subsystem 30 (i.e., regions of no charge separation in the photoreceptor layer). Regions 44 may be much thinner than regions 42, due in part to the attraction of the fluid, in part to evaporation of the image definition material, or a combination of these and other effects.

Figure 6:
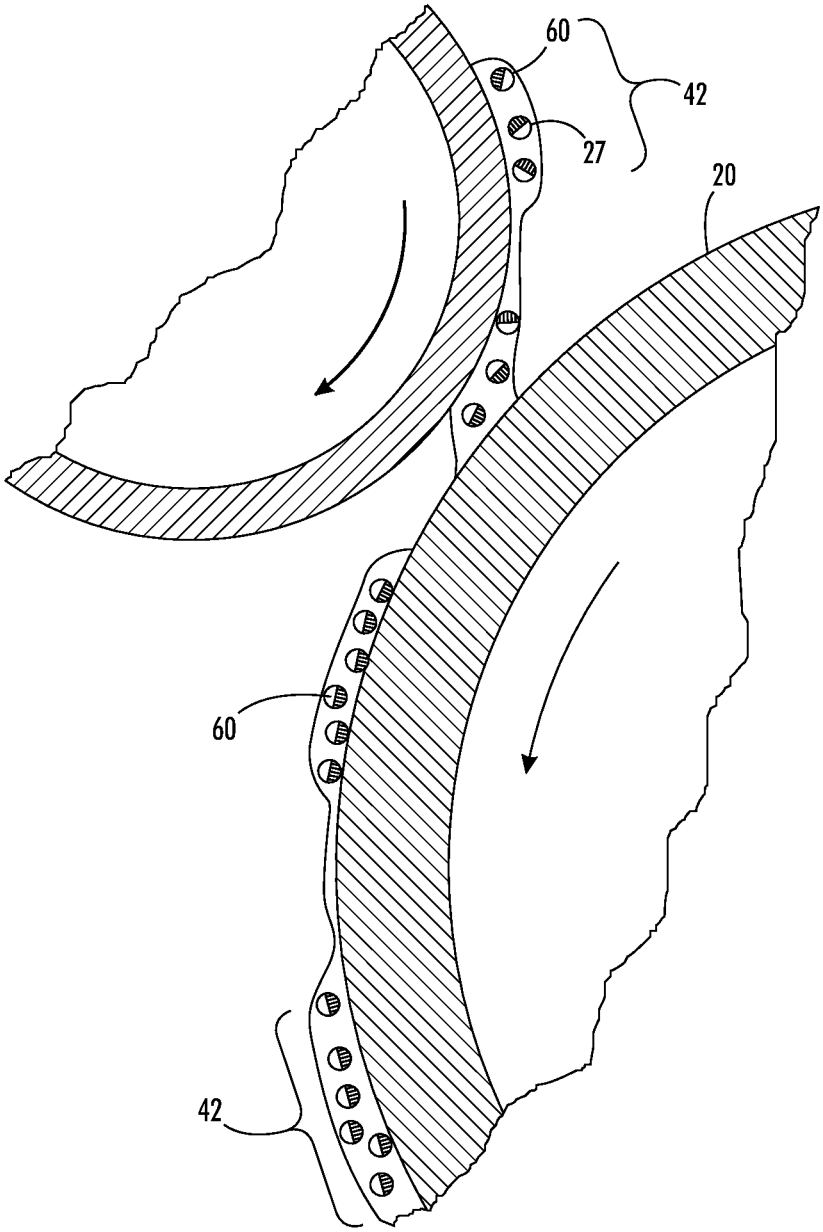
FIG. 6 is a side-view, cut-away illustration of an example of transferring a particle-containing fluid from a photoreceptor surface to a reimageable surface according to one implementation of the present disclosure.

In implementations in which particles are present in the fluid, such as illustrated in FIG. 6, they may be provided to have a surface quality such that they provide liquid drag. This drag means motion of the particles carries with it fluid. Thus, electrostatic attraction between electrolytic image definition material and charged regions of the photoreceptor draw both fluid and particles, and enhance segregation of the particles into regions 42. An image-forming pattern of thick and thin regions of particle-bearing image definition material is thereby formed over photoreceptor 22. In one implementation, regions 42 are on the order of 0.2 μm to 1.0 μm thick, while residual image definition material regions 44 may be on the order of less than 0.1 μm. Due to the volume difference in regions 42 as compared to regions 44, a substantially greater number of particles are present in regions 24 as compared to regions 44.

The image-forming pattern of thick and thin regions of image definition material 27 on photoreceptor 22 may then be transferred to reimageable surface 20 at transfer point 46. As the relative motions of photoreceptor 22 and imaging member 12 proceed, layer 40 is transferred from the surface of photoreceptor 22 to reimageable surface 20, preserving the relative layer thicknesses (and in certain embodiments particle concentrations in regions 42, 44). In one mechanism, the image definition material wets the reimageable surface, and due to the nature of reimageable surface 20 a portion of the image definition material transfers thereto. While some fluid may remain on photoreceptor 22 after transfer of the majority thereof to reimageable surface 20, the relative volume and hence height above reimageable surface 20 of the transferred regions 42, 44 will be sufficient to retain adequate contrast between the amount of the fluid in regions 42 and in regions 44 such that a liquid image is formed on reimageable surface 20.

Figure 3:
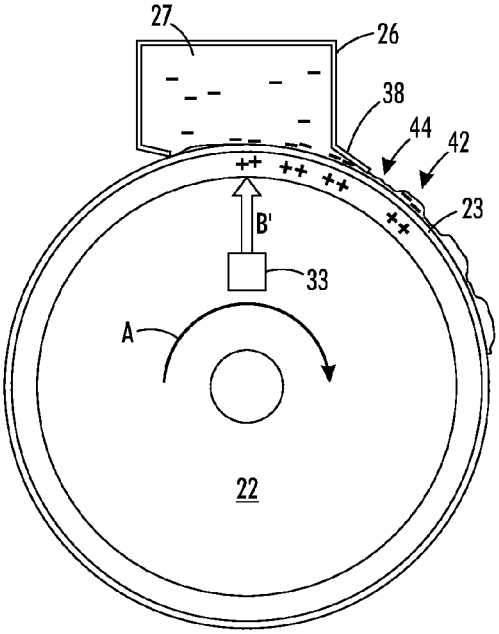
FIG. 3 is side-view, cut-away illustration of a mechanism for selectively applying image definition material to a surface of a photoreceptor according to another implementation of the present disclosure.

According to a variation of the above illustrated in FIG. 3, exposure of photoreceptor 22 may occur from the back-side of photoreceptor 22. For example, the body of photoreceptor 22 may be at least partially optically transparent at the wavelength of a beam B' from source 33. Exposure of the photoreceptor simultaneous with contact between the photoreceptor surface and fluid 27 may thereby be provided. Selective retention of fluid 27 from reservoir 26 then proceeds as described above.

Figure 4:
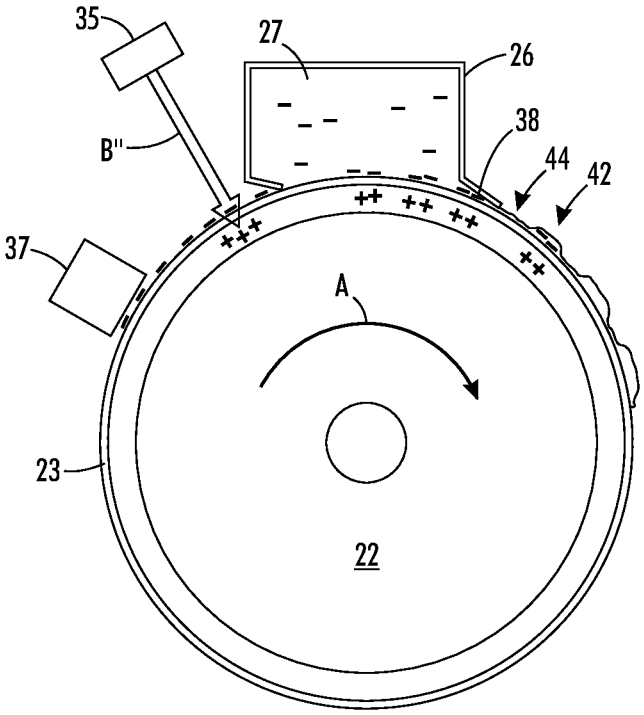
FIG. 4 is side-view, cut-away illustration of a mechanism for selectively applying image definition material to a surface of a photoreceptor according to yet another implementation of the present disclosure.

According to another implementation of the photoreceptor illumination and charging, as seen in FIG. 4 the illumination occurs before the photoreceptor enters the electrolyte bath. A light source 35 is imaged onto the photoreceptor 22 within a charging region, for example from one or more scorotrons 37. The surface of dielectric 23 is thereby charged to a voltage V. In the illuminated regions sufficient charge is liberated to subsequently move through the photoreceptor layer 22 and saturate the capacitance. Then, similar to the case of the charging when in contact with the biased electrolyte bath, the voltage V is dropped across the dielectric layer 23. The image-wise charged surface then enters the electrolyte bath and the electro-wetting process continues as above. In this case biasing the electrolyte bath is optional.

According to another implementation of the present disclosure, the viscosity and/or surface adhesiveness of the image definition material 27 may be intentionally increased, particularly on the exposed surface opposite the surface of photoreceptor 22, so as to increase its transfer efficiency to reimageable surface 20. One mechanism for such viscosity and/or adhesiveness modification is a heating element 48. In addition to viscosity and/or adhesiveness modification, heating element 48 may also assist in evaporating excess residual image definition material.

The material image formed by layer 40 now resident on reimageable surface 20 is next inked by inking subsystem 50 at inking nip 52. Inking subsystem 50 may consist of a "keyless" system using an anilox roller to meter offset ink onto one or more forming rollers. Alternatively, inking subsystem 50 may consist of more traditional elements with a series of metering rollers that use electromechanical keys to determine the precise feed rate of the ink. The general aspects of inking subsystem 50 will depend on the application of the present disclosure, and will be well understood by one skilled in the art.

According to a first embodiment which may be termed positive ink definition imaging, ink 54 at inking nip 52 selectively adheres to the image layer 40 over regions 42. Where ink-philic particles are present, this accumulation is particularly over regions of higher density of these ink-philic particles. One or more of several different mechanisms accomplishes this. In one implementation, the image definition material is ink-philic, and the reimageable surface is ink-phobic. The ink accordingly splits over the reimageable surface and selectively accumulates over regions of image definition material. In another implementation, which may be termed negative ink definition imaging the image definition material is ink-phobic, and the reimageable surface is ink-philic (e.g., non-polar ink and fluorinated silicone). The ink adheres to the fluorinated silicone surface and splits either between the ink and the image definition material or within the image definition material layer.

In embodiments in which ink-philic particles are present in the image definition material, a significant number of ink-philic particles are exposed in regions 42 while fewer particles are exposed in regions 44. The attraction between ink and particle may be physical, chemical, electrostatic, magnetic, or a combination thereof. Therefore, ink will selectively separate to regions 44. In certain implementations, fluid 27 in regions 44 will have substantially evaporated prior to reaching nip 52. In such a case, contrast between inked and non-inked regions are enhanced due to rejection of the ink by the exposed reimageable surface 20 formally occupied by image definition material 27 in regions 44.

For positive ink definition image formation, following nip 52, regions 42 comprise a first layer of image definition material 27 and a second layer thereover of ink 54. In contrast, regions 44 have little if any image definition material therein, and virtually no ink thereover. An inked image is thereby formed. Imaging member 12 carries the inked image to image transfer nip 16. The inked image is next transferred to substrate 14 at transfer subsystem 56. In the implementation illustrated in FIG. 1, this is accomplished by passing substrate 14 through nip 16 between imaging member 12 and impression roller 18. Adequate pressure is applied between imaging member 12 and impression roller 18 such that ink 54 within region 42 is brought into physical contact with substrate 14. Adhesion of the ink to substrate 14 and strong internal cohesion cause the ink to separate from reimageable surface 20 and adhere to substrate 14. Impression roller 18 or other elements of nip 16 may be cooled to further enhance the transfer of the inked image to substrate 14. Indeed, substrate 14 itself may be maintained at a relatively colder temperature than the ink on imaging member 12, or locally cooled, to assist in the ink transfer process.

Optionally, some portion of the electrolytic image definition material (and in certain embodiments, additives therein) may ultimately transfer with the ink to the substrate. In such a case, the image definition material may be constituted to contain additional additives that provide a desired surface quality or functionality to the ink image, such as controlling material viscosity, delivering additives (e.g., photo-curing or thermal-curing agents, fixing agents, etc.), reflectivity (e.g., gloss), mechanical strength, waterproofing, texture, adding encoding material (e.g., magnetic or electrostatically chargeable particles), and so on. Certain of these qualities/functions may be realized by heating or cooling the inked image on substrate 14, by reaction with substrate 14, and so on. In certain implementations, some portion of the image definition particles may transfer with the ink, in which case the image definition particles may serve a dual purpose of ink region definition and surface quality/functionality control.

It will be appreciated that ink is released from reimageable surface 20 at the transfer nip 16 to substrate 14 at a very high efficiency, approaching 100%. The electrolyte image definition material (and optional particles) can act in various ways to assist with this transfer. In one implementation, the electrolyte binds to the surface of the ink and is then released from the surface in the transfer nip when a neutralizing or repulsive field is applied, for example by mechanism 62. Alternatively, some image definition material 27' may also transfer with ink 54 to substrate 14 and separate from reimageable surface 20. In certain implementations, the volume of this transferred image definition material will be minimal, and it will rapidly evaporate, leaving only the particles previously contained therein. The particles may mix within the ink and have no other net effect. In other implementations, the optional particles and/or other agents contained within image definition material 27 may provide the image applied to substrate 14 with certain desirable properties, such as surface finish, surface texture, surface color (or color effects), ink curing, and so on, as discussed above.

Any residual ink 54' and residual image definition material 27" must be removed from reimageable surface 20, preferably without scraping or wearing that surface. Most of the residual image definition material 27" can be easily removed by using an air knife (not shown) with sufficient airflow. In addition to or as an alternative to an air knife, any remaining image definition material and ink residue may be removed by a cleaning subsystem 58 of the type disclosed in the aforementioned U.S. application for letters patent Ser. No. 13/095,714.

Alternatively, it is within the scope of this disclosure that an offset roller (not shown) may first receive the ink image pattern, and thereafter transfer the ink image pattern to a substrate, as will be well understood to those familiar with offset printing. Other modes of indirect transferring of the ink pattern from imaging member 12 to substrate 14 are also contemplated by this disclosure.

Returning to FIG. 1, a charge erasing mechanism 36 is provided to erase the charge image at least for those areas of the photoreceptor 22 where the image is to be varied from the previous print. In one implementation, a (liquid or other) contact is provided to short the field across the photoconductor while it is illuminated with an erase illumination. The drum surface is then cleaned of any electrolyte before the process is repeated.

Figure 5:
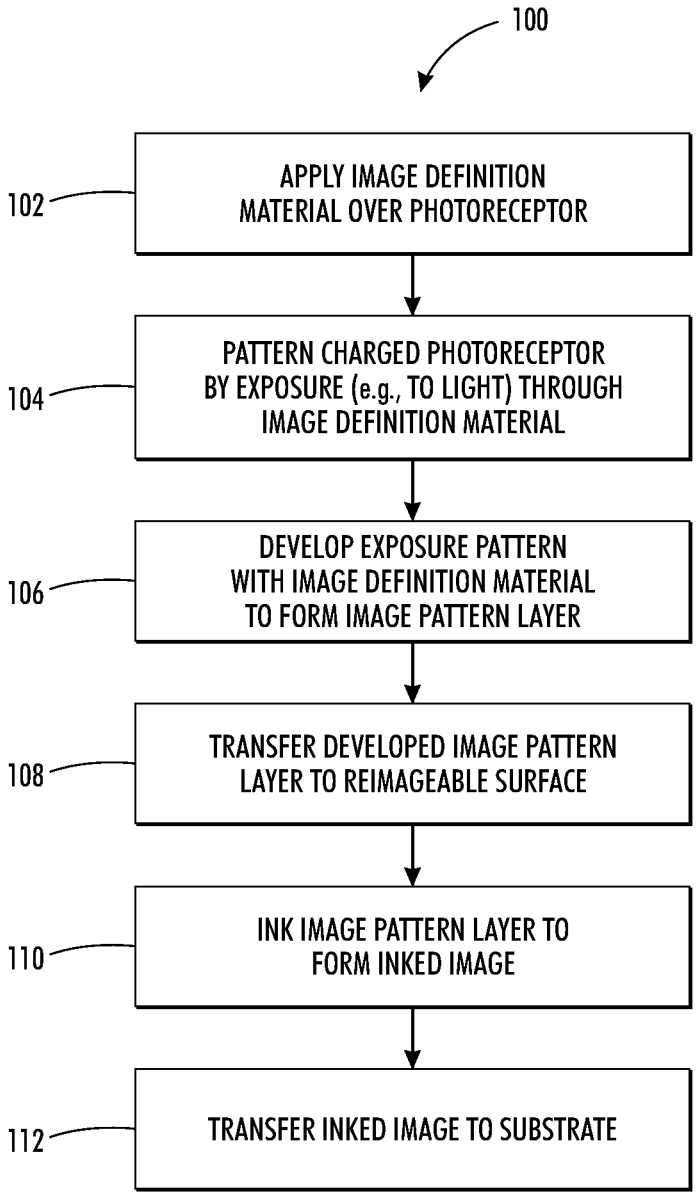
FIG. 5 is a flow diagram illustrating an implementation of operation of a system for variable lithography for example of the type shown in FIG. 1.

Accordingly, a complete hybrid system and process is disclosed in which, with reference to FIG. 5, a process 100 comprises applying an image definition material (with or without particles therein) over a photoreceptor at 102, patterning the photoreceptor through the image definition material at 104, and developing the pattern at 106 utilizing certain aspects of electro-wetting. The image of image definition material is transferred at 108 to an imaging member to act either as a positive latent image or a negative latent image, and inked on the surface of the imaging member at 110. The inked image is then transferred to a substrate at 112 utilizing certain aspects of a variable data lithography system and process. The image definition material provides either a positive or negative latent image, and is transferred to a reimageable surface that has mechanical and energetic properties specifically tuned to provide very highly efficient transfer of an inked image formed thereover to a desired substrate.

As previously mentioned, particles and/or molecules within the image definition material may be bi-functional. That is, the particles and/or molecules may have two opposite poles—one preferentially attractive to the reimageable surface and the other preferentially attractive to the ink. These particles in operation are illustrated with reference to FIG. 6. Image definition material 27 is disposed with reservoir 26 and comprises an electrolytic image definition material in which is disposed bi-functional particles 60. Bi-functional particles and/or molecules 60 are illustrated as generally spherical, with one hemisphere having a hatched pattern representing that that hemisphere is attractive to the reimageable surface 20, and with a second hemisphere having no fill pattern and representing that that hemisphere is attractive to ink. It will be appreciated that FIG. 6 is for illustration purposes only, is not to scale, and that the particles and/or molecules need not necessarily be spherical. As deposited on the surface of photoreceptor 22 from reservoir 26, particles 60 are relatively randomly oriented. As photoreceptor 22 rotates, the layer of image definition material 27 including particles and/or molecules 60 are transferred to reimageable surface 20, by processes described above. Due to the attraction of the shaded hemispheres of particles and/or molecules 60 to reimageable surface 20, the unshaded hemispheres of particles 60 are oriented proximate the surface of layer 40. That is, the ink-attractive regions of particles and/or molecules 60 are presented to the ink-receiving surface of image definition material layer 40. Ink may then preferentially apply over layer 40 by way of the attraction of particles and/or molecules 60, as described above.

Figure 7:
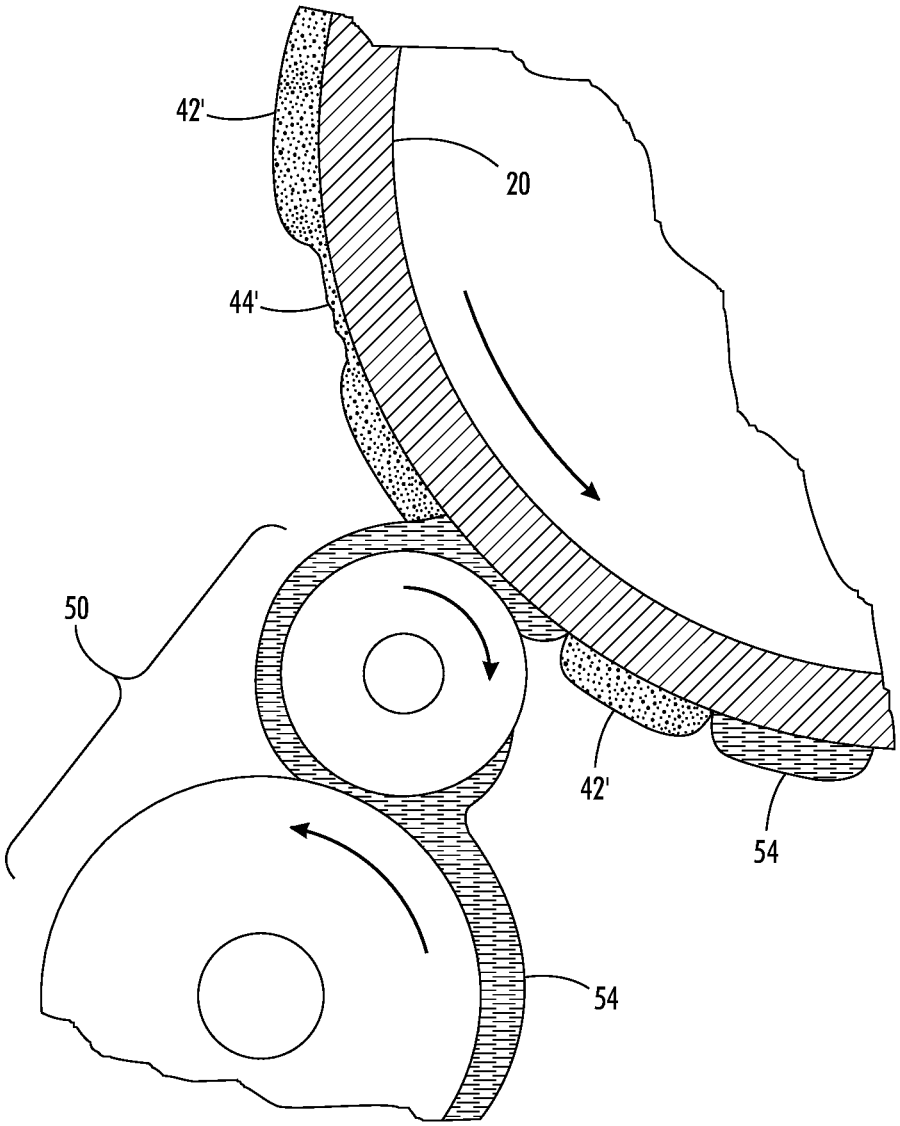
FIG. 7 is side-view, cut-away illustration of another mechanism for selectively applying image definition material to a surface of a photoreceptor according to one implementation of the present disclosure.

While the above discussion has focused on particles or molecules being attractive to ink, in alternate implementations the particles may render regions of the image definition material over reimageable surface ink-phobic and thus perform as a negative latent image. With reference to FIG. 7, regions 42' of particle-bearing image definition material 27 are ink-phobic. As reimageable surface 20 rotates past inking subsystem 50, ink is rejected over regions 42' but is accepted in regions 44'. Ink acceptance may be based on the nature of reimageable surface, on the nature of the electrolytic fluid forming image definition material 27, a thin layer of which may remain in regions 44', by treatment of the ink, by thermal or electrostatic control in the region between inking subsystem 50 and transfer subsystem 56. It will be appreciated that many of the subsystems and mechanisms forming a complete image forming system are not specifically illustrated in FIG. 7, but may be similar to those shown and described with reference to FIG. 1.

Figure 8:
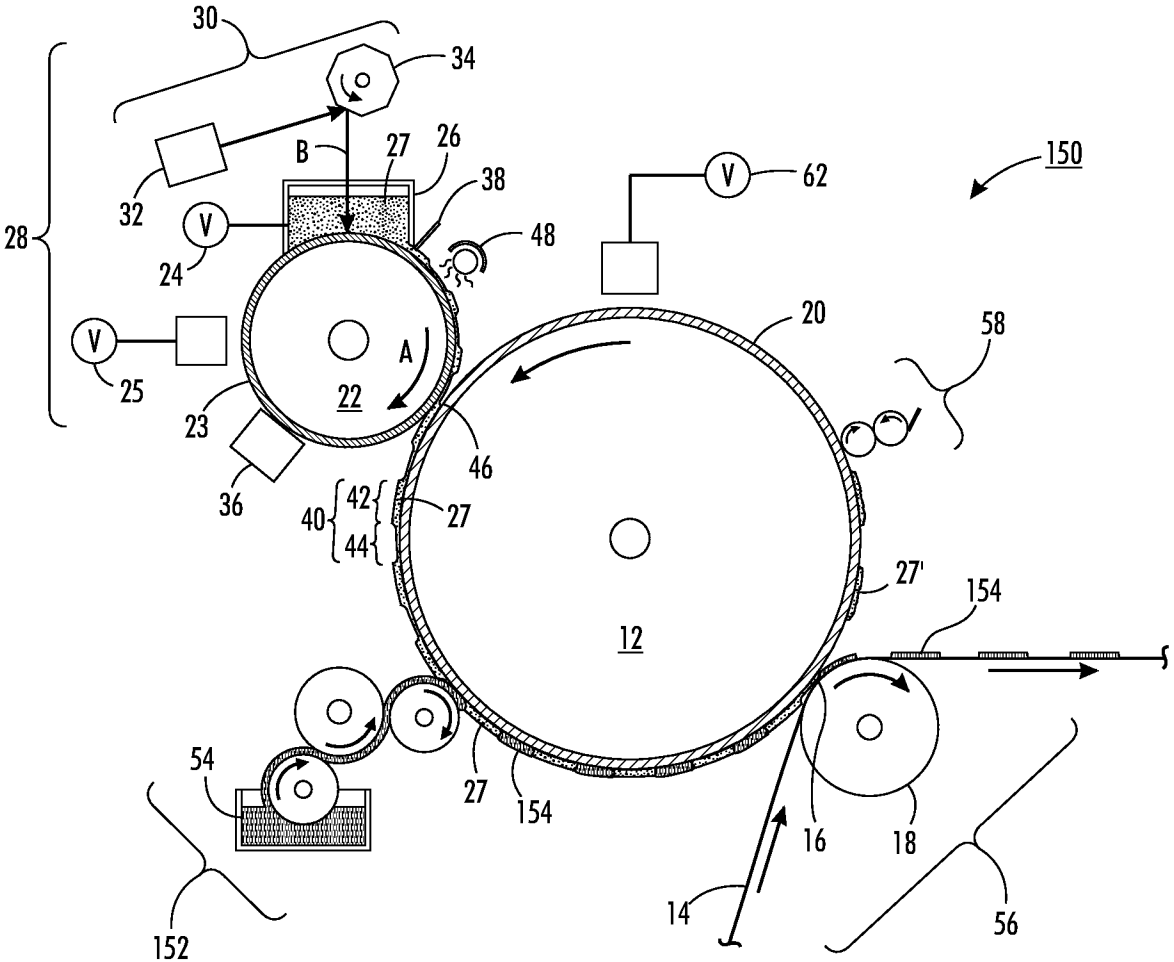
FIG. 8 is a side-view, cut-away illustration of a mechanism for applying ink over a reimageable substrate according to still another implementation of the present disclosure.

With reference to FIG. 8, another embodiment 150 of a variable data lithography system is illustrated. Fluid 27 of embodiment 150 is free of particles, but otherwise may be as previously described. Again, photoreceptor 22 is exposed through reservoir 26 of image definition material 27 (or may be illuminated before reservoir 26 as described above). The electrostatic pattern formed thereby results in negative latent image formation of an electro-wetting pattern of image definition material on the surface of photoreceptor 22. The patterned image definition material layer 40, comprising regions of relatively greater amounts of image definition material 42 and regions of no (or relatively very little) image definition material 44 may then be transferred to reimageable surface 20. In so doing, regions of reimageable surface 20 are exposed in regions 44 between regions of image definition material 42. Ink 154 from inking subsystem 152 is in this embodiment a hydrophobic material. Accordingly, when deposited over reimageable surface 20 by inking subsystem 152, ink 154 preferentially occupies regions 44 *d*, and is rejected by regions 42.

In certain variations, ink 154 will have sufficiently high adhesion to reimageable surface 20 and low cohesive energy so as to split onto regions of reimageable surface 20 exposed in regions 44. Ink 154 may be cohesive enough to split the image definition material between regions 42 and/or have low enough adhesion to image definition material 27 so as to separate from the image definition material regions 42. The image definition material may have a relatively low viscosity. Therefore, areas covered by image definition material may naturally reject the ink because splitting naturally occurs in the image definition material layer that has very low dynamic cohesive energy.

An inked image is therefore formed on reimageable surface 20 by inking subsystem 152. The inked image (ink in regions 44) is next transferred to substrate 14 at transfer subsystem 56. In the embodiment illustrated in FIG. 8, this is accomplished by passing substrate 14 through nip 16 between imaging member 12 and impression roller 18. Adequate pressure is applied between imaging member 12 and impression roller 18 such that the ink 154 is brought into physical contact with substrate 14. Adhesion of the ink to substrate 14 and strong internal cohesion cause the ink to separate from reimageable surface 20 and adhere to substrate 14. Impression roller 18 or other elements of nip 16 may be cooled to further enhance the transfer of the inked latent image to substrate 14. Indeed, substrate 14 itself may be maintained at a relatively colder temperature than the ink on imaging member 12, or locally cooled, to assist in the ink transfer process.

Some image definition material may also wet substrate 14 and separate from reimageable surface 20, however, the volume of this image definition material will be minimal, and it will rapidly evaporate or be absorbed within the substrate. Optimal charge on surface 20 and the electrostatic interaction with the particles in the image definition material will reduce transfer of the image definition material to substrate 14.

In certain implementations, the ink definition image definition material may be sacrificial, and consumed in a print cycle, such as by evaporation or removal and disposition such as by cleaning subsystem 58 (FIG. 1 and FIG. 8). Optionally, any image definition material remaining on reimageable surface 20 can be removed, recycled, and reused.

It will therefore be understood that while a water-based solution is one implementation of an image definition material that may be employed in the implementations of the present disclosure, other non-aqueous image definition materials with low surface tension, that are ink-phobic, are vaporizable, decomposable, or otherwise selectively removable, etc. may be employed. One such class of fluids is the class of HydroFluoroEthers (HFE), such as the Novec brand Engineered Fluids manufactured by 3M of St. Paul, Minn. These fluids have the following beneficial properties in light of the current disclosure: (1) they leave substantially no solid residue after evaporation, which can translate into relaxed cleaning requirements and/or improved long-term stability; (2) they have a low surface energy, as required for proper wetting of the imaging member; and, (3) they are benign in terms of the environment and toxicity. Additional additives may be provided to control the electrical conductivity of the image definition material over the photoreceptor. Other suitable alternatives include fluorinerts and other fluids known in the art, that have all or a majority of the above properties. It is also understood that these types of fluids may not only be used in their undiluted form, but as a constituent in an aqueous non-aqueous solution or emulsion as well.

A system having a single imaging member 12 (in the form of a cylinder), without an offset or blanket cylinder, is shown and described herein. The reimageable surface 20 is made from material that is conformal to the roughness of print media via a high-pressure impression cylinder, while it maintains good tensile strength necessary for high volume printing. Traditionally, this is the role of the offset or blanket cylinder in an offset printing system. However, requiring an offset roller implies a larger system with more component maintenance and repair/replacement issues, increased production cost, and added energy consumption to maintain rotational motion of the drum (or alternatively a belt, plate or the like). Therefore, while it is contemplated by the present disclosure that an offset cylinder may be employed in a complete printing system, such need not be the case. Rather, the reimageable surface layer may instead be brought directly into contact with the substrate to affect a transfer of an ink image from the reimageable surface layer to the substrate. Component cost, repair/replacement cost, and operational energy requirements are all thereby reduced.

It should be understood that when a first layer is referred to as being "on" or "over" a second layer or substrate, it can be directly on the second layer or substrate, or on an intervening layer, or layers may be between the first layer and second layer or substrate. Further, when a first layer is referred to as being "on" or "over" a second layer or substrate, the first layer may cover the entire second layer or substrate or a portion of the second layer or substrate.

The realization and production of physical devices and their operation are not absolutes, but rather statistical efforts to produce a desired device and/or result. Even with the utmost of attention being paid to repeatability of processes, the cleanliness of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary implementations have been presented in the foregoing detailed description, it should be understood that a vast number of variations exist, and these preferred exemplary implementations are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described implementations may be made without departing from the spirit and scope of the disclosure defined by the claims thereto.

What is claimed is:

1. A variable data lithography system, comprising:

a photoreceptor;

an electrolytic image definition material subsystem disposed such that image definition material may be applied over a surface of a region of said photoreceptor;

a charge control subsystem for controlling an electrostatic charging of said photoreceptor;

an exposure subsystem disposed for selective exposure of said region of said photoreceptor while said surface of said region is communicatively coupled to a mechanism for charging to thereby form an exposure pattern from regions that are exposed and unexposed by said exposure subsystem on said surface of said photoreceptor, said exposure enabling altering the electrostatic charge on said photoreceptor to thereby define regions of said photoreceptor having a first electrostatic charge state to which said electrolytic image definition material may be preferentially attracted and a second electrostatic charge state to which said electrolytic image definition material may not be preferentially attracted to thereby form a patterned electrolytic image definition material layer;

an application region whereat the electrolyte adjacent regions having first charge state wet said dielectric layer and electrolyte adjacent regions having second charge state do not wet said dielectric layer;

an imaging member having a reimageable surface formed thereover, disposed proximate said photoreceptor such that said patterned electrolytic image definition material layer is transferred to said reimageable surface; and an inking subsystem for selectively applying ink over said reimageable surface such that said ink preferentially occupies selected regions of said patterned electrolytic image definition material layer on said reimageable surface to thereby form an inked image over said reimageable surface.

2. The variable data lithography system of claim 1, further comprising a dielectric layer over said photoreceptor.

3. The variable data lithography system of claim 1, wherein said first electrostatic charge state corresponds to regions not exposed by said exposure subsystem, and second electrostatic charge state corresponds to regions exposed by said exposure subsystem.

4. The variable data lithography system of claim 1, wherein said regions of said photoreceptor having a first electrostatic charge state have a first charge polarity, and further wherein said electrolytic image definition material subsystem is configured such that electrolytic image definition material may be provided with a second electrostatic charge state having a second charge polarity, said first charge polarity being opposite said second charge polarity.

5. The variable data lithography system of claim 4, further comprising a charging mechanism communicatively coupled to said electrolytic image definition material subsystem to provide said electrolytic image definition material with said second electrostatic charge state having said second charge polarity.

6. The variable data lithography system of claim 4, further comprising a charge application device disposed proximate said imaging member and configured to apply an electrostatic charge of said first polarity to said imaging member such that said electrolytic image definition material is electrostatically attracted to said reimageable surface during transfer thereof from said photoreceptor to said reimageable surface.

7. The variable data lithography system of claim 3, wherein said electrolytic image definition material subsystem is configured to apply an electrolytic image definition material comprising an electrolytic image definition material having image definition particles disposed therein.

8. The variable data lithography system of claim 7, wherein said image definition particles have an affinity to ink applied by said inking subsystem.

9. The variable data lithography system of claim 7, wherein said image definition particles are bi-functional such that one region of each of said particles has an affinity to ink applied by said inking subsystem and another region of each said particle as an affinity to said reimageable surface.

10. The variable data lithography system of claim 7, further comprising an image transfer subsystem for transferring the inked image on said reimageable surface to a substrate, wherein said electrolytic image definition material comprises an additive for providing a desired surface quality to said inked image, and further wherein said image transfer subsystem is configured to transfer at least a portion of said electrolytic image definition material with said inked image to said substrate.

11. The variable data lithography system of claim 10, wherein said desired surface quality is selected from the group consisting of: accelerated curing, reflectivity, mechanical strength, water resistance, texture, color, and encoding.

12. The variable data lithography system of claim 10, said electrolytic image definition material covering said inked image on said substrate.

13. The variable data lithography system of claim 1, further comprising a viscosity control subsystem disposed proximate said photoreceptor following said electrolytic image definition material subsystem in a direction of motion of said photoreceptor for controlling the viscosity of electrolytic image definition material on the surface of said photoreceptor prior to transfer of said electrolytic image definition material to said imaging member.

14. The variable data lithography system of claim 13, wherein said viscosity control subsystem comprises a heating element configured to direct heat energy toward said photoreceptor.

15. The variable data lithography system of claim 1, further comprising a charge erase mechanism disposed proximate said photoreceptor for erasing any charge pattern on said photoreceptor prior to exposure of said photoreceptor by said exposure subsystem.

16. The variable data lithography system of claim 1, wherein electrolytic image definition material subsystem comprises a reservoir containing electrolytic image definition material, and further wherein said exposure subsystem is disposed such that said surface of said region of said photoreceptor is exposed through said electrolytic image definition material within said reservoir.

17. The variable data lithography system of claim 1, further comprising an image transfer subsystem for transferring the inked image on said reimageable surface to a substrate.

18. The variable data lithography system of claim 1, wherein said reimageable surface of said imaging member is a reimageable ink phobic surface, and said electrolytic image definition material includes ink-philic particles.

19. The variable data lithography system of claim 1, wherein the inking subsystem is configured to selectively apply ink over said reimageable surface such that said ink preferentially occupies selected regions of said patterned electrolytic image definition material layer on said reimageable surface to thereby form an inked image on said patterned electrolytic image definition material layer over said reimageable surface.

20. The variable data lithography system of claim 1, wherein the exposure enabling altering the electrostatic charge on the photoreceptor includes dissipation of the electrostatic charge state on the photoreceptor.

21. The variable data lithography system of claim 1, wherein the exposure enabling altering the electrostatic charge on the photoreceptor includes transport of the photogenerated charge through the photorecptor.

22. A variable data lithography system, comprising:

a photoreceptor;

a dielectric layer over said photoreceptor;

a reservoir for receiving an electrolytic image definition material disposed such that a portion of said image definition material may be in contact with a surface of a region of said photoreceptor while disposed within said reservoir;

a first charge control subsystem for applying a first electrostatic charge to said photoreceptor;

a second charge control subsystem for applying a second electrostatic charge to said electrolytic image definition material, said first and said second electrostatic charges being of opposite polarity;

an exposure subsystem disposed for selective exposure of said region of said photoreceptor while said surface of said region is in contact with said electrolytic image definition material to thereby form an exposure pattern from regions that are exposed and unexposed by said exposure subsystem on said surface of said photoreceptor, said exposure enabling dissipation of the electrostatic charge state on said photoreceptor where exposed, to thereby define regions of said photoreceptor having a first electrostatic charge state to which said electrolytic image definition material may be preferentially attracted and a second electrostatic charge state to which said electrolytic image definition material may not be preferentially attracted, to thereby form a patterned electrolytic image definition material image as said photoreceptor exits contact with said electrolytic image definition material within said reservoir;

an imaging member having a reimageable surface formed thereover, disposed proximate said photoreceptor such that said electrolytic damping fluid selectively attracted to said photoreceptor is transferred to said reimageable surface, forming regions of electrolytic image definition material separated by regions of substantially no electrolytic image definition material on said reimageable surface, and thereby transferring said patterned electrolytic image definition material image from said photoreceptor to said reimageable surface;

an inking subsystem for selectively applying ink over said reimageable surface such that said ink is preferentially disposed thereover other than over regions where said electrolytic image definition material is present on said reimageable surface, to thereby form an inked image over said reimageable surface; and an image transfer subsystem for transferring the ink occupying regions over said electrolytic image definition material on said reimageable surface to a substrate to thereby transfer said inked image from said reimageable surface to said substrate.

23. The variable data lithography system of claim 22, wherein said reservoir is configured to receive an electrolytic image definition material comprising an electrolytic image definition material having image definition particles disposed therein.

24. The variable data lithography system of claim 23, wherein said image definition particles are bi-functional such that one region of each of said particles has an affinity to ink applied by said inking subsystem and another region of each said particle as an affinity to said reimageable surface.

25. The variable data lithography system of claim 22, wherein said electrolytic image definition material further comprises additives for providing a desired surface quality to said inked image, and further wherein said image transfer subsystem transfers a portion of said electrolytic image definition material with said inked image to said substrate to provide said inked image with said desired surface quality over said substrate.

26. A variable data lithography system for applying an ink to a substrate, comprising:

a photoreceptor;

a dielectric layer formed over said photoreceptor;

a reservoir containing an electrolytic image definition material disposed such that a portion of said image definition material is retained in physical contact with a surface of said photoreceptor while disposed within said reservoir, said electrolytic image definition material comprising an electrolytic image definition material having image definition particles disposed therein, said image definition particles having an affinity to ink applied by said inking subsystem;

a first charge control subsystem for applying a first electrostatic charge to said photoreceptor;

a second charge control subsystem for applying a second electrostatic charge to said electrolytic image definition material, said first and said second electrostatic charges being of opposite polarity;

an exposure subsystem disposed for selective exposure of said photoreceptor through said reservoir to thereby form an exposure pattern from regions that are exposed and unexposed by said exposure subsystem on said surface of said photoreceptor, said exposure enabling transport of the photogenerated charge through said photoreceptor where exposed, to thereby define regions of said photoreceptor and dielectric layer having a first electrostatic charge state to which said electrolytic image definition material may be preferentially attracted and a second electrostatic charge state to which said electrolytic image definition material may not be preferentially attracted, to thereby form a patterned electrolytic image definition material image as said photoreceptor exits contact with said electrolytic image definition material within said reservoir;

an imaging member having a reimageable surface formed thereover, disposed proximate said photoreceptor such that said electrolytic damping fluid selectively attracted to said photoreceptor is transferred to said reimageable surface, forming regions of electrolytic image definition material separated by regions of substantially no electrolytic image definition material on said reimageable surface, and thereby transferring said patterned electrolytic image definition material image from said photoreceptor to said reimageable surface;

an inking subsystem for selectively applying ink over said reimageable surface such that said ink is preferentially disposed thereover other than over regions where said image definition particles within said electrolytic image definition material is present on said reimageable surface, to thereby form an inked image over said reimageable surface; and an image transfer subsystem for transferring the ink occupying regions over said electrolytic image definition material on said reimageable surface to a substrate to thereby transfer said inked image from said reimageable surface to said substrate.

* * * * *